US005235924A

United States Patent [19]

Slaton et al.

[11] Patent Number: 5,235,924

[45] Date of Patent: Aug. 17, 1993

[54] ANTICOUNTERMEASURE SYSTEM FOR TORPEDOES

[75] Inventors: Jack H. Slaton, Arcadia; David E. Faulkner, Pasadena, both of Calif.

[73] Assignee: The United States of America as represented by the Sectretary of the Navy, Washington, D.C.

[21] Appl. No.: 738,718

[22] Filed: Jun. 11, 1968

[51] Int. Cl.[5] ..... F42B 19/01

[52] U.S. Cl. ..... 114/21.3

[58] Field of Search ..... 114/20, 23, 21.3; 367/1

[56] References Cited

U.S. PATENT DOCUMENTS

| | | | |
|---|---|---|---|
| 2,341,287 | 2/1944 | Pookhir et al. | 114/23 |
| 2,960,956 | 11/1960 | Bennon et al. | 114/23 |
| 2,987,025 | 6/1961 | Cunningham | 114/23 |
| 2,991,742 | 7/1961 | Steinberg | 114/23 |
| 2,995,100 | 8/1961 | Edwards | 114/23 |
| 2,997,971 | 8/1961 | Dickieson | 114/23 |
| 3,011,738 | 12/1961 | Skramstad et al. | 114/20 X |
| 3,015,297 | 1/1962 | Supernaw | 114/23 |
| 3,016,857 | 1/1962 | Hawks | 114/23 |
| 3,024,755 | 3/1962 | Brooks | 114/23 |
| 3,083,666 | 4/1963 | Agins | 114/23 |

*Primary Examiner*—Ian J. Lobo

*Attorney, Agent, or Firm*—Harvey Fendelman; Thomas Glenn Keough

[57] ABSTRACT

A system which overcomes the effects of acoustical torpedo counter-measures by using an attack on a countermeasure as a logical step toward the attack on a "real" target. A slight bearing error is introduced into a torpedo homing system to cause the torpedo to miss a small "decoy" target while permitting a "real" target to be hit. After attacking and missing the "decoy", the system then redirects the torpedo towards the "real" target.

4 Claims, 1 Drawing Sheet

ANTICOUNTERMEASURE SYSTEM FOR TORPEDOES

STATEMENT OF GOVERNMENT INTEREST

The invention described herein may be manufactured and used by or for the government of the United States of America for governmental purposes without the payment of any royalties thereon or therefor.

BACKGROUND OF THE INVENTION

In a homing torpedo of the type which transmits a pulse and receives a return or "echo" pulse, such as the "Underwater Target Detection System" disclosed in the copending patent application of Jack H. Slaton, filed Jun. 18, 1962, Ser. No. 203,406, it is desirable to obtain high sensitivity and simultaneously maintain a low false alarm rate.

Ideally, a homing torpedo should be capable of attacking "real" targets without being influenced by signals from undesired targets or from the ocean itself. However, since water is such a poor medium for transmission, it has often been the practice to home on any acoustical signal received.

Torpedo countermeasures, therefore, seek to confuse the homing system of a torpedo by generating acoustic signals of their own which resemble target echoes or target-radiated noise. In some systems it has been the practice to use signal processing techniques in an attempt to ignore the signals produced by the countermeasures. This practice results in ignoring certain target signals as well, and therefore causing reduced effectiveness of the homing system. Furthermore, this practice ignores the fact that countermeasures are normally in the vicinity of the "real" target, and to be convenient, must be smaller in size than the "real" target.

SUMMARY

In accordance with the present invention, means are provided to inject a small bearing error into the homing system of a torpedo. Thus, if the torpedo proceeds to home on a "decoy" instead of the "real" target, the "decoy" will be missed because of its small size.

After missing the "decoy", the invention causes the torpedo to travel a straight and level course for a prescribed period of time. The invention then causes the torpedo to perform a second search. The bearing error signal will cause the torpedo to miss any decoy on which it homes; however, the torpedo will hit a "real" target because of its physical size.

The sequence of missing a decoy, traveling straight and level, and searching for a target will continue until the "real" target is hit.

DESCRIPTION OF THE PREFERRED EMBODIMENTS

Figure 2:
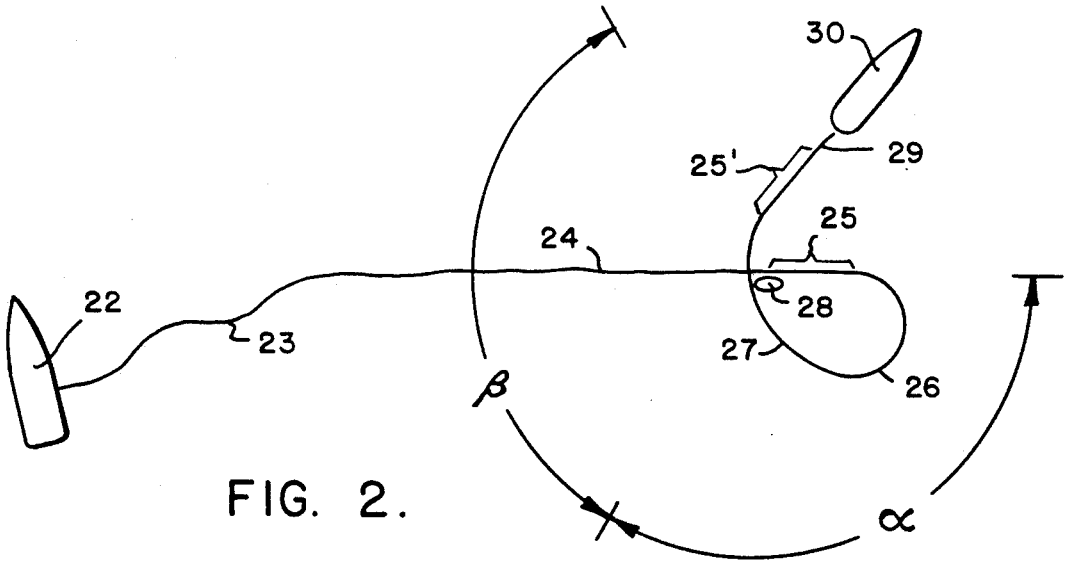
FIG. 2 illustrates the attack path of a torpedo equipped with the invention.

Referring to FIG. 2, launch ship 22 sends out a torpedo to hit target 30. Target 30 releases one or more decoys 28 which emit acoustical sounds. Decoy 28 is physically small in comparison to target 30.

Figure 1:
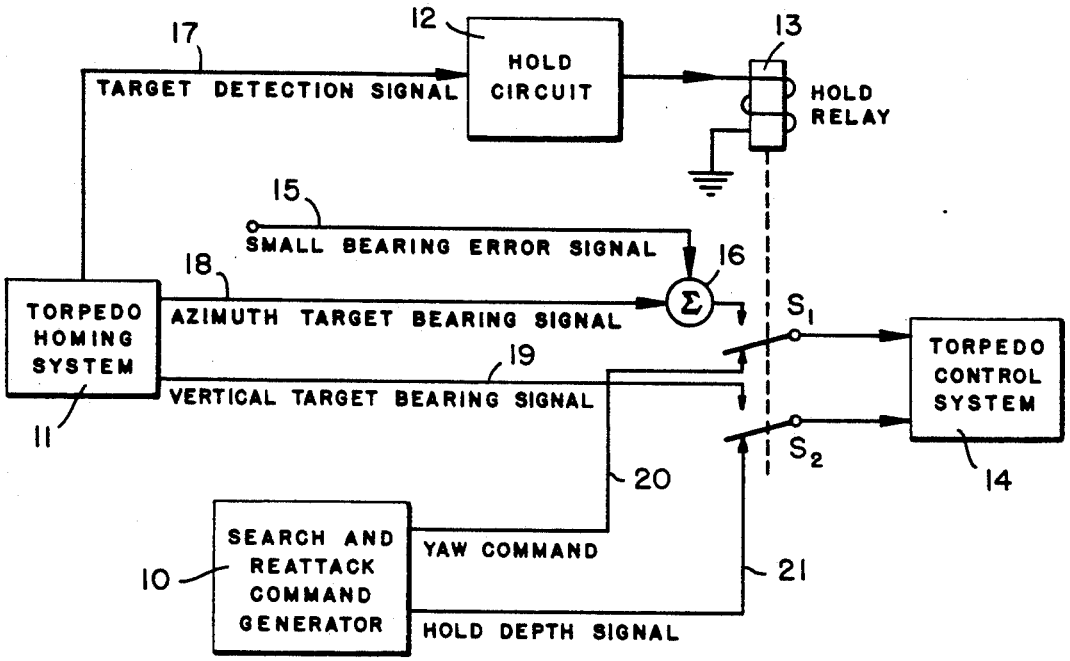
FIG. 1 is a block diagram of an embodiment of the invention.

Turning now to FIG. 1, switches $S_1$ and $S_2$ are shown in their initial position. When an attack begins, a hold relay 13 switches $S_1$ and $S_2$ from the initial position shown to the "attack" position. Torpedo homing system 11, which may be the "Underwater Target Detection System" disclosed in the copending patent application of Jack H. Slaton, filed Jun. 18, 1962, Ser. No. 203,406, is then directly connected to torpedo control system 14. A small bearing error signal 15 is introduced into azimuth target bearing signal 18 by means of summer 16. Thus, the torpedo will miss the acoustic centroid of its target by a small distance.

In this example, a torpedo leaves launch ship 22 and follows a snake search 23 before homing on decoy 28. Path 24 will carry the torpedo just to the left of decoy 28.

As soon as the torpedo misses decoy 28, the high front-to-back discrimination characteristic of the torpedo will cause target detection signal 17 to drop off sharply. Several seconds after the decrease in signal 17, a hold circuit 12 releases hold relay 13 which shifts switches $S_1$ and $S_2$ from the attack position to the position shown in FIG. 1.

Search and reattack command generator 10 is then directly connected to torpedo control system 14. Search and reattack command generator 10 causes the torpedo to travel a straight and level path 25 by means of yaw command 20 and hold depth signal 21. After a preselected time interval, command generator 10 initiates a yaw command 20 and a hold depth signal 21 which cause the torpedo to perform a reattack circle 26 (FIG. 2).

When torpedo homing system 11 senses the presence of a "real" target, or a decoy, target detection signal 17 will increase causing hold circuit 12 to activate hold relay 13 which changes switches $S_1$ and $S_2$ back to the attack position.

Under the guidance of torpedo homing system 11, the torpedo will follow path 27 towards decoy 28. Because of the small bearing error signal 15 introduced into the azimuth target bearing signal 18, the torpedo will miss decoy 28 again.

Target detection signal 17 will drop off causing switches $S_1$ and $S_2$ to shift to directly connect search and reattack command generator 10 with torpedo control system 14.

The torpedo will hold a straight run out course, 25', for a preselected period of time, and just as it starts to make a reattack circle, torpedo homing system 11 will sense the presence of target 30.

Target detection signal 17 will now cause hold circuit 12 to operate hold relay 13 to shift switches $S_1$ and $S_2$ to the attack position. Even though bearing error signal 15 is introduced into azimuth target bearing signal 18, the torpedo will hit target 30 because target 30 is large in comparison to the amount of error introduced.

The process of attack, miss, run straight, circle, attack might continue through several decoy attacks permitting the torpedo to search the entire volume around the decoy with only intermittent interference from the decoy. At some point in the search sequence, the torpedo will acquire and attack target 30, leaving the decoy, or decoys astern where the signal of the decoy can produce only a minimum of interference.

The trajectory shown in FIG. 2 required two attacks on decoy 28 before the attack on target 30 began. If target 30 had been in the sector marked $\alpha$, it can be seen that only one decoy attack would have been required prior to the attack on target 30. If target 30 had been in the sector marked $\beta$, it can be seen that three decoy attacks would probably have been required prior to an attack on target 30.

It should be noted that if a torpedo were dropped from the air, an initial circle search would replace snake search 23.

Obviously many modifications and variations of the present invention may be resorted to by those skilled in the art without departing from the spirit and scope of the invention. It is therefore to be understood that within the scope of the appended claims, the invention may be practiced otherwise than as specifically described.

What is claimed is:

1. An anticountermeasure system which overcomes the effects of torpedo countermeasures utilizing one or more decoys comprising:

a torpedo homing system, capable of generating an azimuth and a vertical target bearing signal, and a target detection signal, for homing on the acoustic centroid of a target, such as a real target or a decoy target;

means for inducing a bearing error into the torpedo homing system with respect to the acoustic centroid of a target to cause the torpedo to completely miss a decoy target, but not a larger real target;

means for detecting when said torpedo has "missed" a decoy target;

means for steering the torpedo in a straight path after a "miss" for a predetermined interval of time;

means for successively and repetitively energizing the torpedo homing system, the error-inducing means, the detecting means and the steering means until a real target is acquired.

2. The system of claim 1 wherein:

the means for inducing a bearing error signal into the torpedo homing system comprises:

means for adding a constant signal to the azimuth target bearing signal of said homing system.

3. The system of claim 2 further comprising:

a search and reattack command generator capable of generating yaw command and "hold-depth" output signals;

a torpedo control system capable of being controlled by the torpedo homing system and the search and reattack command generator; and wherein the means for steering the torpedo in a straight path after a "miss" and the means for successively and repetitively energizing the torpedo homing system, the error-inducing means, the detecting means and the steering means comprises:

switching means capable of disconnecting the torpedo homing system from the torpedo control system and connecting the search and reattack command generator:

the output signals of the search and reattack command generator to the torpedo homing system comprising a constant yaw command and hold depth signal to steer the torpedo in a straight and level path for a preselected time interval; and the output signals of the search and reattack command generator to the torpedo homing system comprising a yaw command and hold depth signal to steer the torpedo in a circle search.

4. The system of claim 3 wherein:

means are provided to detect the presence of a target and cause said switching means to reconnect the torpedo homing system with the torpedo control system to cause the torpedo to hit a real target which is larger in size than a decoy target.

* * * * *